United States Patent [19]

Jacquot

[11] Patent Number: 4,631,438

[45] Date of Patent: Dec. 23, 1986

[54] MULTICHARGED ION SOURCE WITH SEVERAL ELECTRON CYCLOTRON RESONANCE ZONES

[75] Inventor: Bernard Jacquot, Saint Egreve, France

[73] Assignee: Commissariat a l'Energie Atomique, Paris, France

[21] Appl. No.: 678,821

[22] Filed: Dec. 6, 1984

[30] Foreign Application Priority Data

Dec. 7, 1983 [FR] France ..... 83 19572

[51] Int. Cl.[4] ..... H05H 00/00

[52] U.S. Cl. ..... 313/359.1; 315/111.71; 315/111.81

[58] Field of Search ..... 313/359.1; 315/111.71, 315/111.81, 111.91, 5.41, 5.42, 5.35

[56] References Cited

U.S. PATENT DOCUMENTS

| | | | |
|---|---|---|---|
| 3,665,245 | 5/1972 | Schwartz | 315/111.91 |
| 4,223,246 | 9/1980 | Osepchuck | 315/5.35 |
| 4,393,333 | 7/1983 | Sakudo et al. | 315/111.81 |
| 4,409,520 | 10/1983 | Koike et al. | 315/111.81 |
| 4,417,178 | 11/1983 | Geller et al. | 315/111.81 |
| 4,507,588 | 3/1985 | Asmussen et al. | 315/111.81 |

FOREIGN PATENT DOCUMENTS 2069230 8/1981 United Kingdom .

OTHER PUBLICATIONS

IEEE Transactions on Nuclear Science, col. NS-26, No. 2, Apr. 1979, pp. 2120–2126, New York (USA); R. Geller: "Electron cyclotron resonance (E.C.R.) multiply charged ion sources". *Figure 7a*

IEEE Transactions on Nuclear Science, col. NS-26, No. 3, Jun. 1979, pp. 3680–3682, New York (USA); V. Bechtold et al.: "An ECR-type light ion source for the Karlsruhe isochronous cyclotron". *Figure 3*

*Primary Examiner*—David K. Moore

[57] ABSTRACT

Multicharged ion source with several electron cyclotron resonance zones. The source comprises a sealed enclosure containing a gas for forming a plasma confined in said enclosure, means for producing a high frequency electromagnetic field within the enclosure, means for producing within the enclosure a group of radial and axial, local magnetic fields and defining equimagnetic surfaces permitting the confinement of the plasma on one of these surfaces, the electron cyclotron resonance condition being satisfied, the group having an axis of symmetry, means for extracting the ions through the orifice made in the wall of the enclosure and located on the axis of symmetry and means for reducing, outside the volume occupied by the plasma, the amplitude of the local axial magnetic fields in the vicinity of and slightly upstream of the extraction orifice in n zones located outside the axis, so that new ionizing electron cyclotron resonances appear in these zones.

5 Claims, 4 Drawing Figures

MULTICHARGED ION SOURCE WITH SEVERAL ELECTRON CYCLOTRON RESONANCE ZONES

BACKGROUND OF THE INVENTION

The present invention relates to a multicharged ion source with a plurality of electron cyclotron resonance zones. It has numerous applications, as a function of the different kinetic energy values of the extracted ions, in the field of ion implantation, microetching and more particularly in particle accelerator equipment, used both in the scientific and medical fields. In electron cyclotron resonance sources, the ions are obtained by ionizing, within a closed enclosure of the ultra-high frequency cavity type, a gas e.g. constituted by metal vapours, by means of an electron plasma highly accelerated by electron cyclotron resonance. This resonance is obtained as a result of the combined action of a high frequency electromagnetic field injected into the enclosure containing the gas to be ionized and a magnetic field prevailing in said enclosure, whose amplitude B satisfies the following electron cyclotron resonance condition: $B=f.2\pi m/e$, in which e represents the electron charge, m its mass and f the frequency of the electromagnetic field.

In this type of source, the quantity of ions which can be produced results from the competition between two processes, on the one hand the formation of the ions by electron impact on neutral atoms constituted the gap to be ionized and on the other hand the destruction of the same ions by single or multiple recombination, during a collision of the latter with a neutral atom. The latter can come from a gas which is not yet ionized or can be produced on the enclosure walls by the impact of an ion thereon.

The problem in this type of source is consequently to minimize the destruction of the ions formed, by preventing any collision thereof with a neutral atom.

In order to obviate this disadvantage, consideration has been given to the confinement within the enclosure forming the source of the ions formed, together with the electrons used for their ionization. This is brought about by producing within the enclosure a group of radial and axial, local magnetic fields, defining a so-called equimagnetic closed surface having no contact with the walls of the enclosure and on which the electron cyclotron resonance condition is satisfied. This surface forms the location of the points, where the amplitude of the local magnetic field has the same value. Such a source is described in French Pat. No. 2,485,798, filed on 13th Feb. 1980 by the present Applicant.

The nearer this equimagnetic surface to the walls of the enclosure, the greater its effectiveness, because it makes it possible to limit the volume of the neutral atoms present and consequently the neutral atom - ion collision quantity. However, there is a serious risk of this surface touching the inner walls of the enclosure and it is then preferable to use a second equimagnetic surface, whose amplitude is tuned to a frequency differing from the electromagnetic field, which automatically imposes the use of a second ultra-high frequency generator.

SUMMARY OF THE INVENTION

The present invention relates to a multicharged ion source with electron cyclotron resonance making it possible to minimize the effects of recombination by the collision of ions with neutral atoms, whilst obviating the use of a second ultra-high frequency generator.

More specifically, the present invention relates to a multicharged ion source comprising a sealed enclosure containing a gas for forming a plasma confined in said enclosure, means for producing within said enclosure a high frequency electromagnetic field, means for producing in said enclosure a group of radial and axial, local magnetic fields defining at least one equimagnetic surface permitting the confinement of the plasma produced by the electron cyclotron resonance whereof the condition on said surface has been satisfied, said group having an axis of symmetry, and means for extracting the ions through an orifice made in the walls of the enclosure and located on the axis of symmetry, wherein the source comprises means for reducing, outside the volume occupied by the confinement plasma, the amplitude of the local axial magnetic fields in the vicinity of and slightly upstream of the extraction orifice in n samll zones located outside the axis of symmetry on the one hand and on the other hand in a more total manner in the complete volume downstream of said orifice. This reduction makes it possible for new ionizing electron cyclotron resonances to appear in the n zones.

According to a preferred embodiment of the invention, the local radial fields are produced by means of several magnetic bars arranged symmetrically around the enclosure and each constituted by several elementary magnets, the terminal elementary magnets of said bars level with the extraction orifice having the same polarity, so as to in part form the means for reducing the amplitude of the local axial magnetic fields.

Preferably, the magnetic bars are made from $SmCo_5$, said material having remarkable macroscopic anisotropy properties and a high magnetic rigidity.

In order to increase or modify in space the effect of the reduction in the axial magnetic fields, an iron shield joined to the enclosure externally thereof and level with the extraction orifice can be advantageously provided. The axis of symmetry of this shield coincides with that of the group of magnetic fields.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
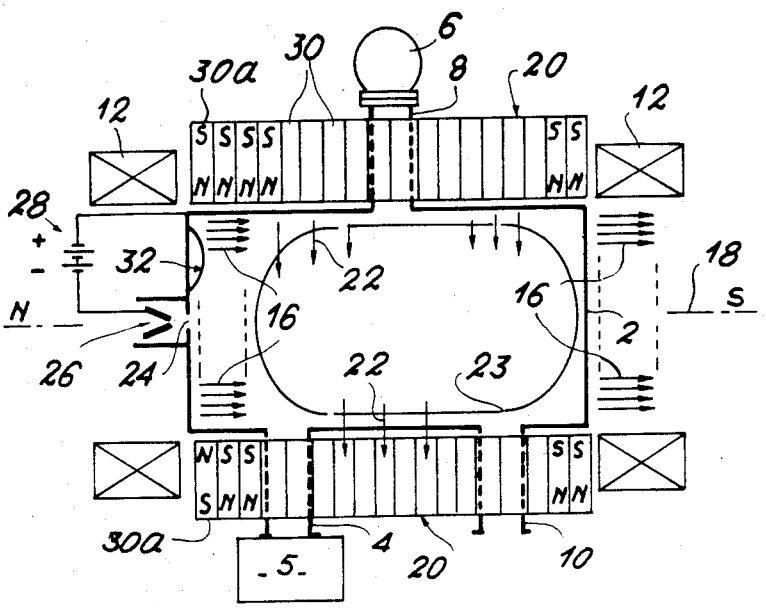
FIG. 1 diagrammatically and in longitudinal section, an ion source according to the invention.

FIG. 1 diagrammatically shows in longitudinal section an electron cyclotron resonance ion source. This source comprises a sealed confinement enclosure 2 constituting a resonant cavity. Enclosure 2 is joined by means of a pipe 4 to a vacuum pump 5 making it possible to produce a high vacuum in the enclosure. Enclosure 2 can be excited by an ultra-high frequency electromagnetic field produced by a generator 6, said field being introduced into the enclosure by means of a waveguide 8. An ionizable gas can be introduced into enclosure 2 by a pipe 10.

Coils such as 12 arranged around enclosure 2 make it possible to produce therein local magnetic fields, which are symbolized by arrow 16 and which are parallel to an axis 18, which can e.g. be the axis of symmetry of enclosure 2. In the same way, magnetic bars 20 arranged around the said cavity make it possible to produce local magnetic fields, symbolized by the arrows 22 and positioned radially with respect to axis 18. As the group of axial and radial, local magnetic fields has as its axis of symmetry the axis 18, it is possible to define closed equimagnetic surfaces such as 23 (location of the points where the amplitude of the local magnetic fields has the same value) having no contact with the walls of enclosure 2. In the manner explained hereinbefore, the electron cyclotron resonance condition is satisfied on one of these inner surfaces.

The existence of such a resonant surface (cf the aforementioned patent specification) makes it possible to strongly ionize the gas contained in enclosure 2, thus giving rise to a very high energy electron plasma. This surface also makes it possible to confine the ions and the electrons produced by the ionization of the gas. As a result of this confinement, the electrons produced have the time to bombard the same ions several times and to totally ionize it.

It is of fundamental importance that this resonant surface also permits a very effective in situ ionic pumping, which ipso facto limits destructive neutral atom - ion charge exchange collisions within the volume defined by said resonant surface.

The highly charged or multicharged ions formed in this way can then be extracted from the enclosure 2, which for this purpose has an extraction orifice 24 on the axis of symmetry 18, e.g. by means of an electrode 26 raised to a negative potential with the aid of a power supply 28. The ions extracted from enclosure 2 in this way can then be selected as a function of the degree of ionization with the aid of any known means utilizing the magnetic field and/or an electric field.

In order to minimize the destructive effects of the charge exchange collisions referred to hereinbefore, but on this occasion between the resonant surface and the extraction orifice, the invention proposes the reduction of the amplitude of the local axial magnetic fields in the vicinity of the extraction orifice 24 and more specifically downstream thereof and slightly upstream in the vicinity of the axis of symmetry 18. This reduction of the local axial magnetic fields can be effected outside the volume occupied by the electron plasma, confined within the equimagnetic surface 23 which is furthest to the outside and which is not intersected by the wall, so as to prevent any modification to the shape and location of said surface.

Figure 2:
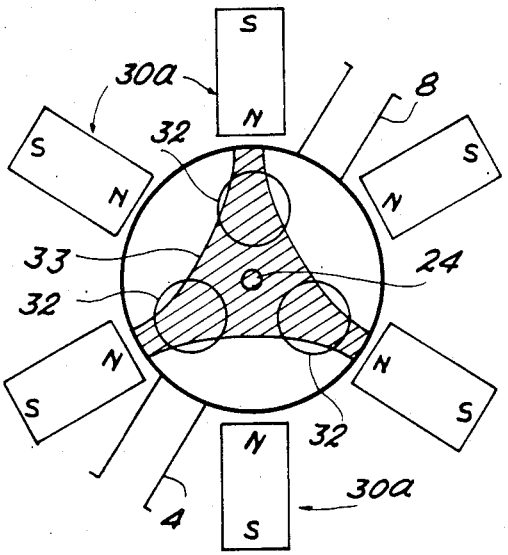
FIG. 2 diagrammatically, a cross-section level with the orifice for extracting ions from the source of FIG. 1.

This reduction can be advantageously brought about by using magnetic bars 20 formed from several joined elementary magnets 30, which are preferably made from $SmCo_5$, the terminal elementary magnets 30*a* of the different bars 30 level with the extraction orifice 24 having the same polarity, which is in this case a north polarity (N), as shown in FIGS. 1 and 2. In the prior art ion sources, the polarities of the terminal elementary magnets 30*a* alternated between north and south. The uniform polarity of the elementary magnets 30*a* must have the same name or polarity (FIG. 1) as that of the face of the coils 12 located in the vicinity of said magnets, i.e. in the vicinity of the extraction orifice 24.

This uniform polarity of elements 30*a* makes it possible to form several equimagnetic caps 32, on which the electron cyclotron resonance condition is satisfied. The dimensions and consequently the effectiveness of these caps 32 can be modified by slightly varying the amplitude of the local radial fields produced by coils 12.

The number of equimagnetic caps 32 is dependent on the number of magnetic bars 20. The use of 2n magnetic bars permits the formation of n equimagnetic caps. In the case shown in FIG. 2, n is taken equal to 3. These caps 32 located in the ion extraction zone make it possible to minimize the recombination of the ions with the neutral atoms more particularly produced on the walls of the enclosure close to the extraction orifice.

Thus, these caps obtained by a local decrease in the axial magnetic fields make it possible, as a result of the electron cyclotron resonance of their surface, to locally produce relatively high energy electron plasmas in order to ionize at least once the neutral atoms normally present at the extraction orifice 24.

In FIG. 2, the regions 32 represent the zones in which is realised the reduction of the axial local magnetic fields in accordance with the invention.

However, in said FIG. 2, the hatched zone 33 represents the zone for forming the neutral atoms responsible for the destructive ion charge exchange.

The possibility of reducing the amplitude of the local axial magnetic field 16 (FIG. 1) at the extraction orifice 24, by acting on the structure of the magnetic bars 20 producing the local radial magnetic fields 22 is based on the fact that said bars produce axial magnetic components at their end bearing in mind the inevitable magnetic leaks.

Figure 3:
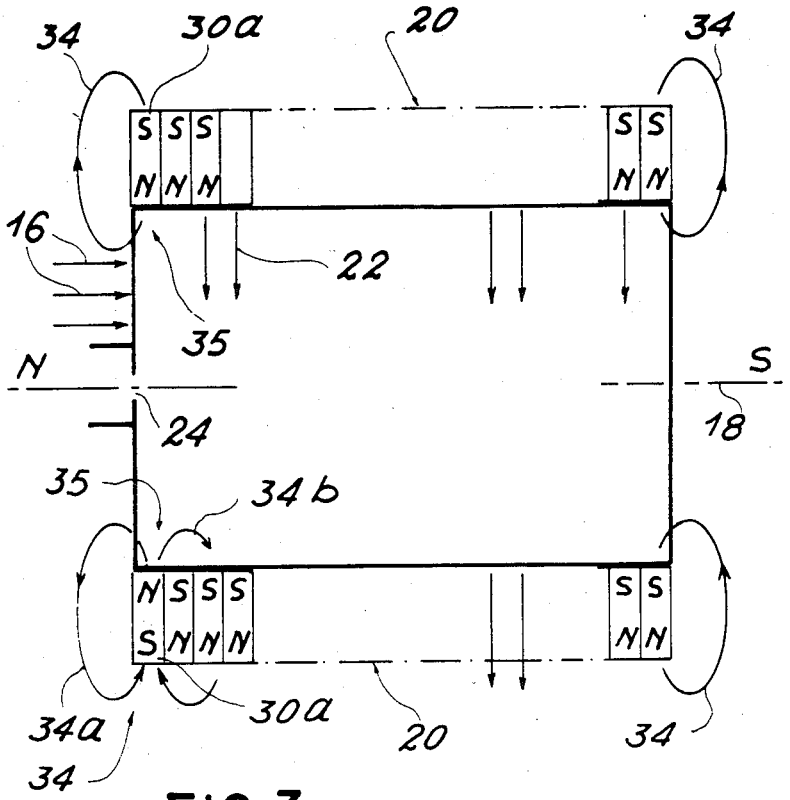
FIG. 3 a diagrammatic view comparable to FIG. 1 illustrating the distribution of the local magnetic fields.

FIG. 3 shows the magnetic lines of force of the axial leakage fields produced at the ends of magnetic bars 20. These magnetic lines of force are designated by the reference numeral 34. The use of terminal elementary magnets 30*a* of the same polarity (north) at the extraction orifice 24 makes it possible, bearing in mind the flow direction of the axial leak field line 34*a*, to greatly locally reduce the axial magnetic fields mainly produced by coils 12, in the vicinity of and slightly upstream of the extraction orifice, outside the axis of symmetry on the one hand and on the other hand in a more total manner in the complete volume located downstream of said orifice. The weak axial magnetic field areas level with orifice 24 carry the reference numeral 35.

In the same way, the use of these terminal elementary magnets 30*a* makes it possible, bearing in mind the direction of flow of the axial leak field line 34*b*, to increase the axial magnetic field produced by the coils 12, upstream of and relatively remote from the extraction orifice. This overall increase of the axial magnetic field makes it possible to move the resonant equimagnetic surface 23 away from the ion extraction zone and consequently to reduce the risk of having said surface touch the enclosure walls.

Figure 4:
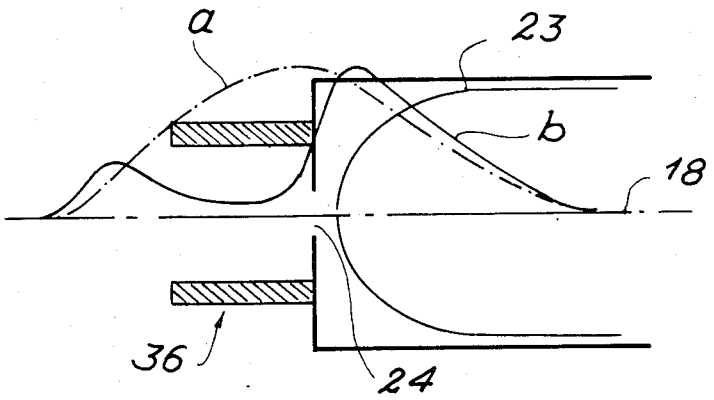
FIG. 4 a diagrammatic view illustrating the supplementary influence of an iron shield on the amplitude variations of the axial magnetic fields along the axis of symmetry of the source.

In order to increase or modify in space the effect of the reduction in the axial magnetic fields already brought about by magnets 30*a*, an iron shield 36, as shown in FIG. 4, can be joined to enclosure 2, externally thereof and level with the extraction orifice 24. The axis of symmetry of iron shield 36 coincides with axis 18. This shield 36 makes it possible to increase the reduction in the local axial magnetic fields downstream of orifice 24 and particularly the local axial magnetic field on axis 18. Thus, said shield 36 contributes to the formation and positioning of the resonant equimagnetic caps 32. However, it should be noted that the use of this shield 36 alone, i.e. without the terminal elementary magnets 30*a* of the same polarity, would not make it possible to form resonant equimagnetic caps. Curves a and b in FIG. 4 respectively illustrate the amplitude of the magnetic fields on axis 18 with and without shield 36.

What is claimed is:

1. A multicharged ion source comprising a sealed enclosure containing a gas for forming a plasma confined within said enclosure, means for producing within said enclosure a high frequency electromagnetic field, means for producing within said enclosure a group of axial and radial, local magnetic fields defining equimagnetic surfaces for confining said plasma produced by electron cyclotron resonance whereof the condition has been satisfied on one of them, said group having an axis of symmetry, means for extracting said ions through an orifice made on the wall of said enclosure and located on said axis of symmetry, said means for producing said local fields comprising first and second alternated magnetic bars arranged symmetrically around said enclosure and formed by several elementary magnets, the magnets of said first bars having polarities opposed to the polarities of the magnets of said second bars except that the terminal elementary magnets situated at the extraction orifice have the same polarity in order to reduce outside the volume occupied by the confined plasma, the amplitude of the local axial magnetic fields located in the vicinity of the extraction orifice, slightly upstream and downstream of said orifice, in n small zones located outside the axis of symmetry.

2. A multicharged ion source comprising a sealed enclosure containing a gas for forming a plasma confined within said enclosure, means for producing within said enclosure a high frequency electromagnetic field, means for producing within said enclosure a group of axial and radial, local magnetic fields defining equimagnetic surfaces for confining said plasma produced by electron cyclotron resonance whereof the condition has been satisfied on one of them, said group having an axis of symmetry, means for extracting said ions through an orifice made on the wall of said enclosure and located on said axis of symmetry, and means for reducing, outside the volume occupied by said confined plasma, the amplitude of said local axial magnetic fields located in the vicinity of said extraction orifice, slightly upstream and downstream of the extraction orifice, in order to form n small equimagnetic zones located outside the axis of symmetry, on which zones the condition of electron cyclotron resonance is satisfied.

3. An ion source according to cliam 2, wherein said means for producing said local fields comprise first and second alternated magnetic bars arranged symmetrically around said enclosure and each formed by several elementary magnets, the magnets of said first bars having polarities opposed to the polarities of the magnets of said second bars except that the terminal elementary magnets situated at the extraction orifice have the same polarity, said terminal elementary magnets forming in part said means for reducing the amplitude of said axial magnetic fields.

4. An ion source according to claim 2, wherein an iron shield, forming in part said means for reducing the amplitude of said axial magnetic fields, is provided, said shield having an axis of symmetry which coincides with the axis of said group and being joined to the enclosure, external thereof and at the extraction orifice.

5. An ion source according to claim 2, wherein the magnetic bars are made from $SmCo_5$.

* * * * *